US005709528A

United States Patent [19]

Hablanian

[11] Patent Number: 5,709,528

[45] Date of Patent: Jan. 20, 1998

[54] TURBOMOLECULAR VACUUM PUMPS WITH LOW SUSCEPTIBLITY TO PARTICULATE BUILDUP

[75] Inventor: Marsbed Hablanian, Wellesley, Mass.

[73] Assignee: Varian Associates, Inc., Palo Alto, Calif.

[21] Appl. No.: 770,632

[22] Filed: Dec. 19, 1996

[51] Int. Cl.[6] ..... F01D 1/36; F03B 5/00

[52] U.S. Cl. ..... 415/90; 415/121.2; 415/143; 415/169.1

[58] Field of Search ..... 415/90, 143, 121.2, 415/169.1, 173.5, 173.1, 170.1, 174.5; 417/244, 313, 423.4

[56] References Cited

U.S. PATENT DOCUMENTS 5,238,362 8/1993 Carsaro et al. .

5,358,373 10/1994 Hablanian ..... 415/90

FOREIGN PATENT DOCUMENTS 3919529 1/1990 Germany .

*Primary Examiner*—Christopher Verdier

*Attorney, Agent, or Firm*—Bella Fishman; William R. McClellan

[57] ABSTRACT

A molecular drag compressor includes a rotor disk and a stator that defines a tangential flow channel having an inlet and an outlet. A stationary baffle is disposed in the tangential flow channel adjacent to the outlet. The baffle is spaced from the rotor disk by a gap. A surface of the baffle facing the rotor disk has surface irregularities including peaks for defining the gap and valleys between the peaks for accumulation of particles. The surface irregularities may form a series of grooves. The molecular drag compressor is preferably utilized in a high vacuum pump which includes an axial turbomolecular compressor and a molecular drag compressor. Additional features which limit the effect of particulate accumulation in molecular drag compressors are disclosed.

25 Claims, 8 Drawing Sheets

TURBOMOLECULAR VACUUM PUMPS WITH LOW SUSCEPTIBLITY TO PARTICULATE BUILDUP

FIELD OF THE INVENTION

This invention relates to turbomolecular vacuum pumps used for evacuating an enclosed vacuum chamber and, more particularly, to turbomolecular vacuum pumps which have low susceptibility to particulate buildup resulting from particles entrained in the gases pumped from the chamber.

BACKGROUND OF THE INVENTION

Conventional turbomolecular vacuum pumps include a housing having an inlet port, an interior chamber containing a plurality of axial pumping stages and an exhaust port. The exhaust port is typically attached to a roughing vacuum pump. Each axial pumping stage includes a stator having inclined blades and a rotor having inclined blades. The rotor and stator blades are inclined in opposite directions. The rotor blades are rotated at high speed to provide pumping of gases between the inlet port and the exhaust port. A typical turbomolecular vacuum pump may include nine to twelve axial pumping stages.

Variations of the conventional turbomolecular vacuum pump are known in the prior art. In one prior art configuration, one or more of the axial pumping stages are replaced with disks which rotate at high speed and function as molecular drag stages. This configuration is disclosed in U.S. Pat. No. 5,238,362 issued Aug. 24, 1993 to Casaro et at. and assigned to the Assignee of the present invention. A turbomolecular vacuum pump including an axial turbomolecular compressor and a molecular drag compressor in a common housing is sold by Varian Associates, Inc. under Model No. 969-9007. Turbomolecular vacuum pumps utilizing molecular drag disks and regenerative impellers are disclosed in German Patent No. 3,919,529 published Jan. 18, 1990.

Molecular drag compressors include a rotating disk and a stator. The stator defines a tangential flow channel and an inlet and an outlet for the tangential flow channel. A stationary baffle, often called a stripper, disposed in the tangential flow channel separates the inlet and the outlet. As is known in the art, the momentum of the rotating disk is transferred to gas molecules within the tangential flow channel, thereby directing the molecules toward the outlet. The rotating disk and the stator of the molecular drag compressor are separated by a small gap, typically on the order of 0.005 inch, selected to permit unrestricted rotation of the disk, while minimizing leakage through the gap.

Prior art vacuum pumps which include an axial turbomolecular compressor and a molecular drag compressor provide generally satisfactory performance under a variety of conditions. However, such vacuum pumps are frequently utilized for evacuation of semiconductor process chambers. The processes performed in such chambers inherently generate particles in the form of molecules and agglomerations of molecules in a variety of sizes and species. As the chamber is vacuum pumped, the gas carries the particles into the vacuum pump.

Particles entrained in the gas being pumped by the molecular drag compressor may adhere to the walls of the compressor, particularly in regions where the gas flow changes direction or is turbulent. It has been found that particles tend to accumulate in the gap between the stationary baffle and the rotor disk. With sufficient particle accumulation, difficulties may be encountered in restarting the pump after shutdown, or a gradual increase in motor torque requirement, overheating and seizure may occur. The accumulated particles fill the gap and increase the frictional forces that must be overcome by the motor upon starting. Typically, the high speed motors used for vacuum pumps of this type do not have high starting torque. When the vacuum pump cannot be restarted, it must be repaired or replaced. It is therefore desirable to provide high vacuum pumps of this type which have low susceptibility to particulate buildup.

SUMMARY OF THE INVENTION

According to a first aspect of the invention, a molecular drag compressor comprises a rotor disk coupled to a drive shaft for rotation about an axis and a stator disposed around the rotor disk. The stator defines a tangential flow channel, an inlet to the tangential flow channel and an outlet from the tangential flow channel. The molecular drag compressor further comprises a stationary baffle disposed in the tangential flow channel adjacent to the outlet. The baffle and the rotor disk have a gap between them. A surface of the baffle facing the rotor disk has surface irregularities including peaks for defining the gap and valleys between the peaks for accumulation of particles.

The peaks preferably comprise spaced-apart ridges. The ridges and valleys preferably define a series of grooves. The ridges may have sharp edges which are substantially uniformly spaced from the rotor disk. The ridges are preferably disposed substantially perpendicular to a direction of rotation of the rotor disk.

The molecular drag compressor is preferably utilized in an integral high vacuum pump. The high vacuum pump comprises an outer pump housing, an axial turbomolecular compressor disposed in the housing and a molecular drag compressor disposed in the housing. The turbomolecular compressor and the molecular drag compressor each have a rotating portion coupled to a single motor drive shaft aligned along the axis of the pump housing.

According to a feature of the invention, the outlet of the tangential flow channel may be spaced upstream in the gas flow from the stationary baffle, thereby defining a space between the outlet and the baffle for particulate accumulation. This feature may be utilized separately or in combination with other features of the invention.

According to another feature of the invention, the stator and stationary baffle may be shaped to provide a smoothly-curved transition between the tangential flow channel and the outlet, thereby producing laminar flow from the tangential flow channel to the outlet. This feature may be utilized separately or in combination with other features of the invention.

According to a further feature of the invention, the tangential flow channel may include at least one surface having surface irregularities, such as ridges, grooves, recesses and the like, which promote accumulation of particles. This feature may be utilized separately or in combination with other features of the invention.

According to another aspect of the invention, an integral high vacuum pump is provided. The high vacuum pump comprises an outer pump housing, an axial turbomolecular compressor disposed in the housing and a molecular drag compressor disposed in the housing. The turbomolecular compressor and the molecular drag compressor each have a rotating portion coupled to a single motor drive shaft aligned along the axis of the housing. The high vacuum pump further comprises a particle separator disposed in the housing between the turbomolecular compressor and the molecular drag compressor for removing particles from gas flowing from the turbomolecular compressor to the molecular drag compressor.

According to still another aspect of the invention, an integral high vacuum pump is provided. The high vacuum pump comprises an outer pump housing, an axial turbomolecular compressor disposed in the housing and a molecular drag compressor disposed in the housing. The turbomolecular compressor and the molecular drag compressor each have a rotating portion coupled to a single motor drive shaft aligned along the axis of the housing. The molecular drag compressor includes at least first and second stages, each having an inlet and an outlet. The high vacuum pump further comprises a particulate filter coupled in a conduit between the outlet of the first stage and the inlet of the second stage. The particulate filter is preferably located externally of the pump housing.

BRIEF DESCRIPTION OF THE DRAWINGS

For a better understanding of the present invention, reference is made to the accompanying drawings, which are incorporated herein by reference and in which.

DETAILED DESCRIPTION

Figure 1:
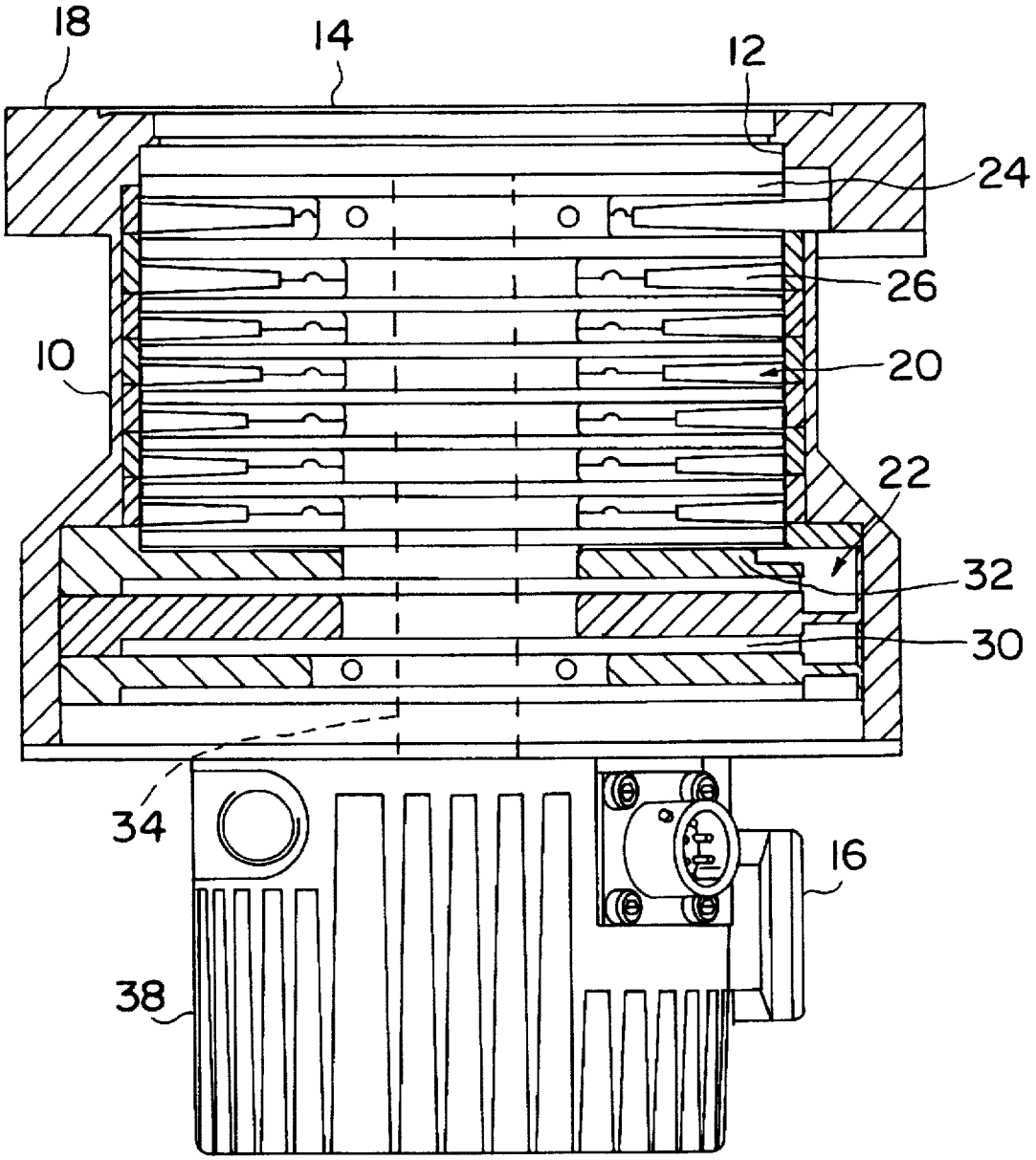
FIG. 1 is a cross-sectional elevation view of a high vacuum pump which includes an axial turbomolecular compressor and molecular drag compressor.

An integral high vacuum pump suitable for incorporation of the present invention is shown in FIG. 1. A housing 10 defines an interior chamber 12 having an inlet port 14 and an exhaust port 16. The housing 10 includes a vacuum flange 18 for sealing the inlet port 14 to a vacuum chamber (not shown) to be evacuated. The exhaust port 16 is typically connected to a roughing vacuum pump (not shown). In cases where the vacuum pump is capable of exhausting to atmospheric pressure, the roughing pump is not required. Located within housing 10 is an axial turbomolecular compressor 20, which typically includes several axial turbomolecular stages, and a molecular drag compressor 22, which typically includes several molecular drag stages. Each stage of the axial turbomolecular compressor 20 includes a rotor 24 and a stator 26. Each rotor and stator has inclined blades as is known in the art. Each stage of the molecular drag compressor 22 includes a rotor disk 30 and a stator 32. The molecular drag compressor 22 is described in more detail below. The rotor 24 of each turbomolecular stage and the rotor 30 of each molecular drag stage are attached to a drive shaft 34. The drive shaft 34 is rotated at high speed by a motor located in a motor housing 38.

Figure 2:
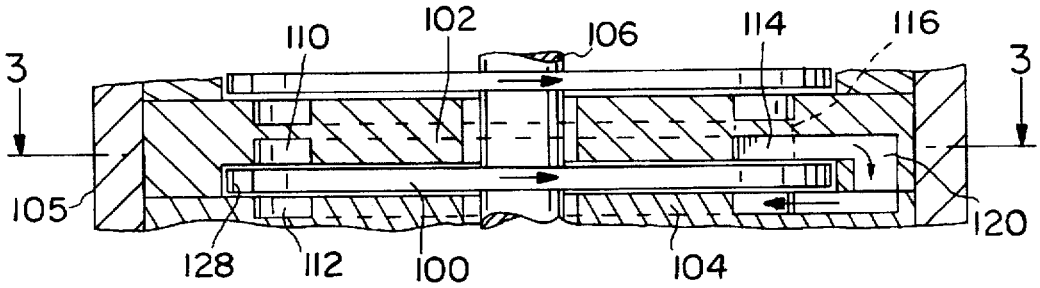
FIG. 2 is a cross-sectional elevation view of a first embodiment of a molecular drag vacuum pumping stage.
Figure 3:
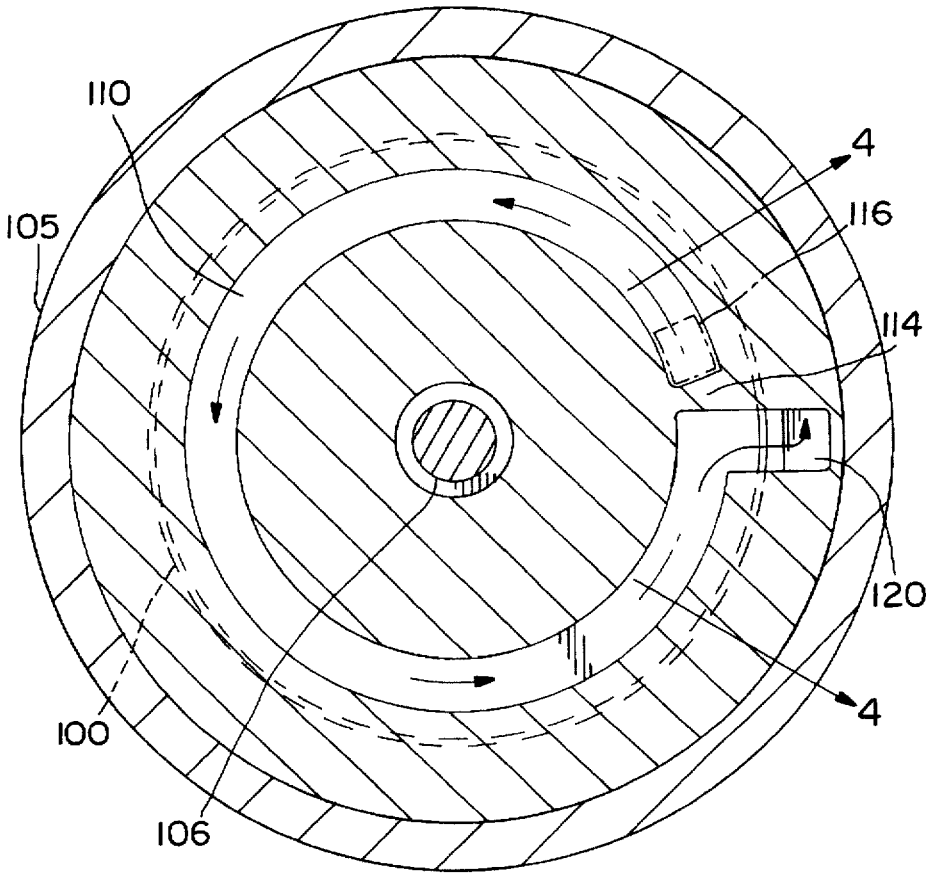
FIG. 3 is a cross-sectional plan view of the molecular drag stage, taken along the line 3—3 of FIG. 2.
Figure 4:
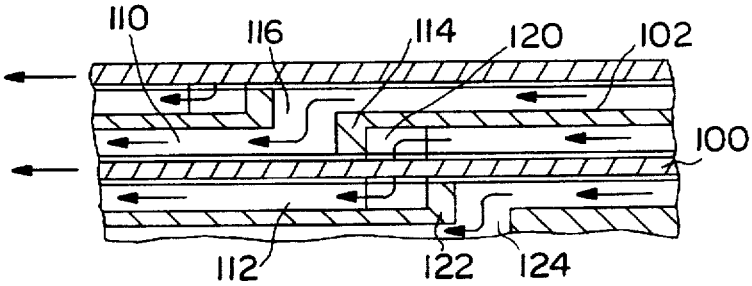
FIG. 4 is a partial cross-sectional elevation view of the molecular drag stage, taken along the line 4—4 of FIG. 3.

An example of the molecular drag compressor 22 is shown in FIGS. 2–4. In the molecular drag compressor, the stator is provided with one or more tangential flow channels. Each tangential flow channel has an inlet and an outlet separated by a stationary baffle. When the disk is rotated at high speed, gas is pumped through the tangential flow channel by molecular drag produced by the rotating disk.

As shown in FIGS. 2–4, a molecular drag stage includes a disk 100, an upper stator portion 102 and a lower stator portion 104 mounted within a housing 105. The upper stator portion 102 is located in proximity to an upper surface of disk 100, and lower stator portion 104 is located in proximity to a lower surface of disk 100. The upper and lower stator portions 102 and 104 together constitute the stator for the molecular drag stage. The disk 100 is attached to a shaft 106 for rotation at high speed.

The upper stator portion 102 has an upper tangential flow channel 110 located in opposed relationship to the upper surface of disk 100. The lower stator portion 104 has a lower tangential flow channel 112 located in opposed relationship to the lower surface of disk 100. In the embodiment of FIGS. 2–4, the tangential flow channels 110 and 112 are circular and are concentric with the disk 100. The upper stator portion 102 includes a stationary baffle 114 which blocks tangential flow channel 110 at one circumferential location. The channel 110 receives gas from a previous stage through an inlet 116 on one side of baffle 114. The gas is pumped through the tangential flow channel 110 by molecular drag produced by the rotating disk 100. At the other side of baffle 114, a conduit 120, formed in stator portions 102 and 104, interconnects channels 110 and 112 around the outer peripheral edge of disk 100. The lower stator portion 104 includes a stationary baffle 122 which blocks lower tangential flow channel 112 at one circumferential location. The lower channel 112 receives gas on one side of baffle 122 through conduit 120 from the upper surface of disk 100 and discharges gas to the next stage through a conduit 124 on the other side of baffle 122.

In operation, gas is received from the previous stage through inlet 116. The previous stage can be a molecular drag stage, an axial turbomolecular stage, or any other suitable vacuum pumping stage. The gas is pumped around the circumference of upper tangential flow channel 110 by molecular drag produced by rotation of disk 100. The gas then passes through conduit 120 around the outer periphery of disk 100 to lower tangential flow channel 112. The gas is then pumped around the circumference of lower tangential flow channel 112 by molecular drag and is exhausted through conduit 124 to the next stage or to the exhaust port of the pump. In the embodiment illustrated in FIGS. 2–4, upper channel 110 and lower channel 112 are connected such that gas flows through them in series. Also in the embodiment of FIGS. 2–4, the upper tangential flow channel 110 and the lower tangential flow channel 112 are spaced inwardly from the outer peripheral edge of disk 100. This configuration limits leakage between channels 110 and 112 around the outer edge of disk 100, except through conduit 120.

Figure 5A:
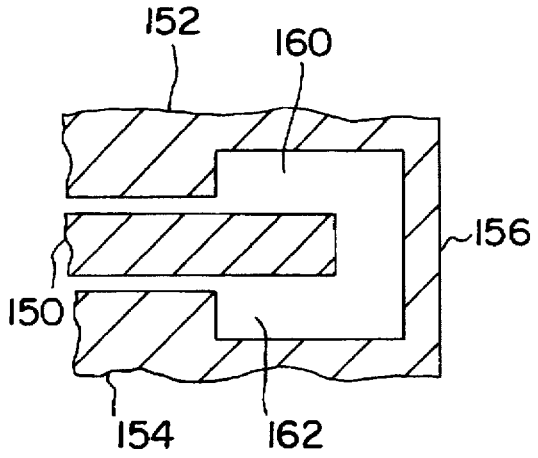
FIG. 5A is a partial cross-sectional view of a second embodiment of the molecular drag stage, showing the tangential flow channel.
Figure 5B:
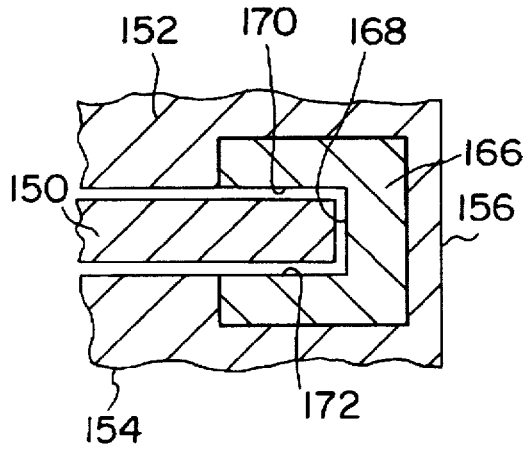
FIG. 5B is a partial cross-sectional view of the molecular drag stage of FIG. 5A, showing the stationary baffle between the inlet and the outlet.

A second embodiment of the molecular drag stage is shown in FIGS. 5A and 5B. A partial cross-sectional view of the molecular drag stage near the outer periphery of the rotor disk is shown. In the embodiment of FIGS. 5A and 5B, a rotor disk 150 is positioned between an upper stator portion 152 and a lower stator portion 154. The upper stator portion 152 defines an upper tangential flow channel 160 above rotor disk 150, and the lower stator portion 154 defines a lower tangential flow channel 162 below rotor disk 150. A peripheral stator portion 156 is spaced from the outer periphery of rotor disk 150, so that upper and lower tangential flow channels 160 and 162 are effectively connected in parallel. As shown in FIG. 5B, a stationary baffle 166 is positioned in tangential flow channels 160 and 162 at one circumferential location so as to substantially block gas flow between the inlet and outlet, except through each tangential flow channel.

Figure 6A:
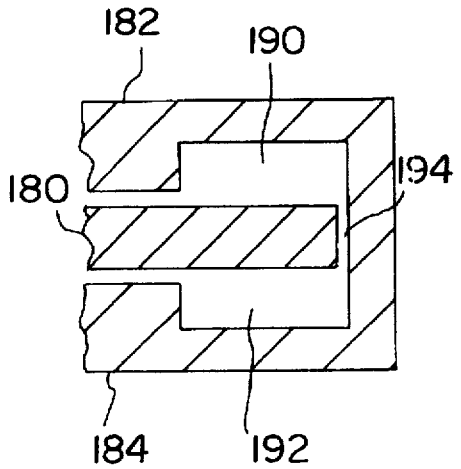
FIG. 6A is a partial cross-sectional view of a third embodiment of the molecular drag stage, showing the tangential flow channel.
Figure 6B:
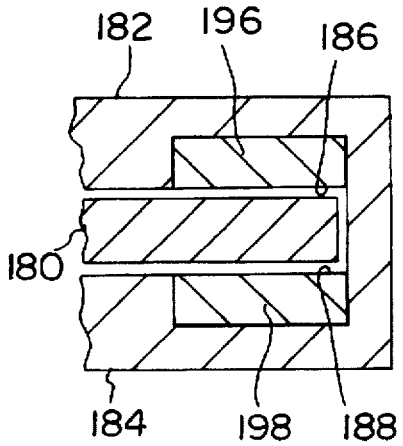
FIG. 6B is a partial cross-sectional view of the molecular drag stage of FIG. 6A, showing the stationary baffle between the inlet and outlet.

A third embodiment of the molecular drag stage is shown in FIGS. 6A and 6B. A partial cross-sectional view of the molecular drag stage near the outer periphery of the rotor disk is shown. A rotor disk 180 is positioned between an upper stator portion 182 and a lower stator portion 184. The upper stator portion 182 defines an upper tangential flow channel 190, and the lower stator portion 184 defines a lower tangential flow channel 192. A small gap 194 between the outer periphery of rotor disk 180 and a peripheral stator portion 186 permits rotation of rotor disk 180 but substantially blocks gas flow between tangential flow channels 190 and 192. Thus, tangential flow channels 190 and 192 may be connected in series. As shown in FIG. 6B, a stationary baffle 196 is positioned in upper tangential flow channel 190 at one circumferential location, and a stationary baffle 198 is positioned in lower tangential flow channel 192 at one circumferential location. Each of the stationary baffles 196 and 198 is positioned between the inlet and the outlet of the respective tangential flow channel and substantially blocks gas flow between the inlet and the outlet, except through each tangential flow channel.

It will be understood that the tangential flow channels of a molecular drag stage may have a variety of configurations and shapes. However, in each case, a stationary baffle is typically positioned at one circumferential location of the tangential flow channel to substantially block direct gas flow between the inlet and the outlet, except through the tangential flow channel. Nonetheless, some gas leaks through the gap between the rotor disk and the stationary baffle. As indicated above, particulate accumulation in the gap between the stationary baffle and the rotor disk may have adverse effects on the operation of the vacuum pump.

A first aspect of the invention is illustrated with reference to FIGS. 7A and 7B. Partial schematic elevation and plan views, respectively, of a molecular drag stage are shown. A rotor disk 200 rotates about an axis 202. A stator 204 positioned below rotor disk 200 defines a tangential flow channel 206. The stator 204 further defines an inlet (not shown) to the tangential flow channel 206 and an outlet 208 from the tangential flow channel 206. A stationary baffle 210 is disposed in tangential flow channel 206 adjacent to outlet 208. The baffle 210 may, but is not required to be, an integral part of the stator 204.

In accordance with the invention, a surface 212 of baffle 210 facing rotor disk 200 has surface irregularities including peaks and valleys. In the embodiment of FIGS. 7A and 7B, the surface 212 of baffle 210 facing rotor disk 200 includes spaced-apart ridges 220 which have valleys 222 between them. The ridges and valleys form a pattern of grooves or serrations. The peaks of ridges 220 define a gap 230 between rotor disk 200 and baffle 210. The valleys 222 provide spaces for accumulation of particles. The peaks of ridges 220 preferably have sharp edges. The valleys 222 may have a variety of shapes as described below. In the embodiment of FIGS. 7A and 7B, the ridges 220 and valleys 222 form a series of triangular grooves. The grooves may be radial with respect to axis 202, may be inclined at a small angle with respect to radial or may be parallel to each other, but are preferably disposed substantially perpendicular to the direction of rotation of rotor disk 200.

The gap 230 between rotor disk 200 and baffle 210 typically has a dimension in a range of about 0.002 to 0.010 inch. The peaks of ridges 220 may be spaced apart by distances L in a range of about 5 to 25 times the dimension of the gap. The valleys preferably have depths H in a range of about 0.5 to 2 times the spacings between ridges. However, the present invention is not limited to these ranges. The main requirement is to provide a surface having peaks for defining the gap 230 and limiting gas flow between rotor disk 200 and baffle 210, and valleys for accumulation of particles. The leakage of gas through the gap between baffle 210 and rotor disk 200 when the baffle surface has a pattern of grooves is not substantially greater than the leakage when the baffle surface is flat, for equal gap dimensions. Until the valleys fill with particles, the risk of the particulate accumulation producing friction between rotor disk 200 and baffle 210 is low. Thus, the operating life of the vacuum pump is extended.

Figure 7A:
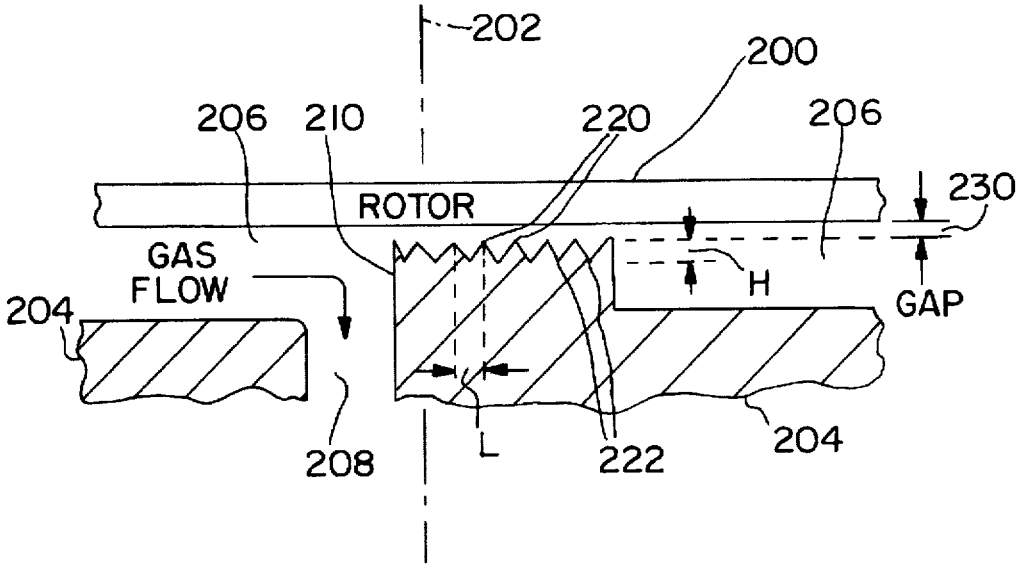
FIGS. 7A and 7B are partial schematic cross-sectional elevation and plan views, respectively, of a molecular drag stage, showing a baffle having grooves for particle accumulation in accordance with the invention.
Figure 7B:
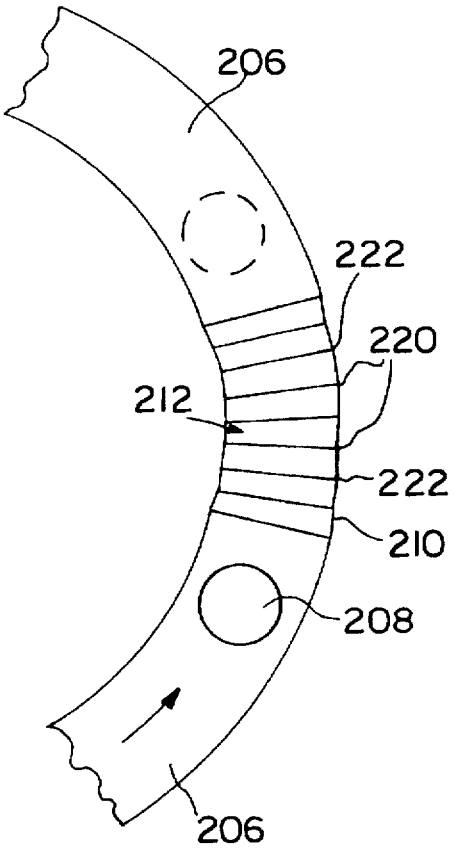
Figure 8:
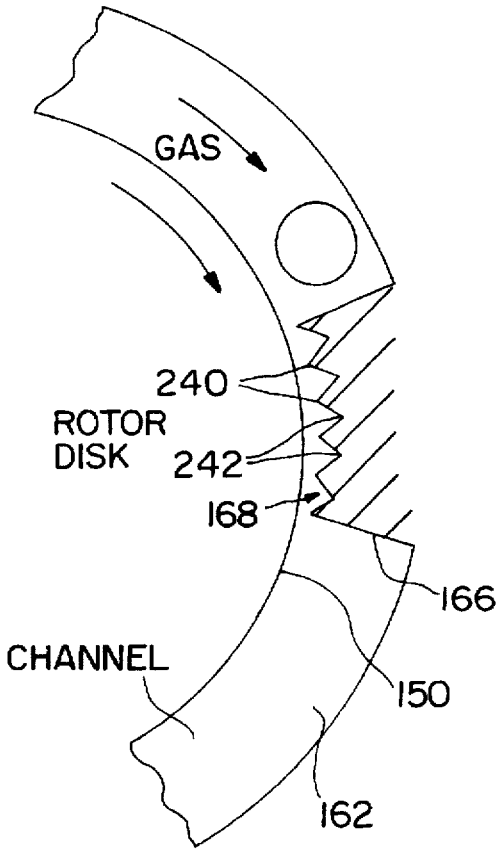
FIG. 8 is a partial schematic cross-sectional plan view of a molecular drag stage, showing a stationary baffle having grooves for particle accumulation in accordance with the invention.
Figure 9A:
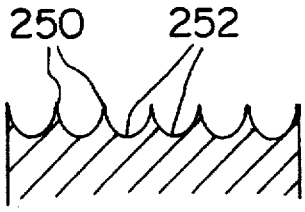
FIGS. 9A–9C show cross-sectional views of alternate groove configurations.
Figure 9B:
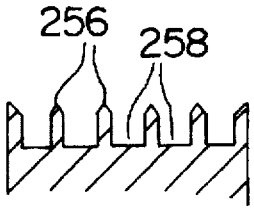
Figure 9C:
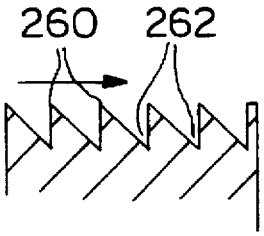

The embodiments of the molecular drag stages shown in FIGS. 2–4, 5A, 5B, 6A and 6B may utilize the grooved or serrated baffle as shown in FIG. 7A. In particular, each baffle surface that faces the rotor disk may have a grooved or serrated surface. Thus, for example, surfaces 168, 170 and 172 of baffle 166 in FIG. 5B and surfaces 186 and 188 of baffles 196 and 198, respectively, in FIG. 6B may be grooved as described above. When the baffle is spaced from the upper surface or the lower surface of the rotor disk, the grooved surface has the configuration shown in FIGS. 7A and 7B. With reference to FIG. 5B, the surface 168 of baffle 166 facing the outer periphery of rotor disk 150 may have a grooved or serrated surface as illustrated in FIG. 8. In particular, the surface 168 of baffle 166 facing the outer periphery of rotor disk 150 is provided with ridges 240 separated by valleys 242. The configuration of the ridges 240 and valleys 242 may be similar to that of the ridges 220 and valleys 222 described above in connection with FIGS. 7A and 7B, except that the peaks of ridges 240 define an arc that matches the curvature of the outer periphery of rotor disk 150. The peaks of ridges 240 are spaced from rotor disk 150 by a gap that is selected to permit unrestricted rotation of rotor disk 150, while limiting gas leakage through the gap. Alternate configurations of the grooved surface of the stationary baffle are shown in FIGS. 9A–9C. In FIG. 9A, peaks 250 are separated by curved valleys 252. In FIG. 9B, peaks 256 are separated by generally rectangular valleys 258. In FIG. 9C, peaks 260 are separated by triangular valleys 262. The configuration of FIG. 9C differs from that of FIG. 7A in that one wall of each valley is perpendicular to the surface. The groove configurations shown in FIGS. 7A and 9A–9C are given by way of example only and are in no way limiting as to the scope of the invention. It will be understood that a variety of different groove configurations may be utilized within the scope of the present invention. As noted above, the peaks define the gap between the baffle and the rotor disk, and the valleys provide spaces for accumulation of particles. The turbulence produced by the peaks tends to carry particles into the valleys where they accumulate.

Figure 10:
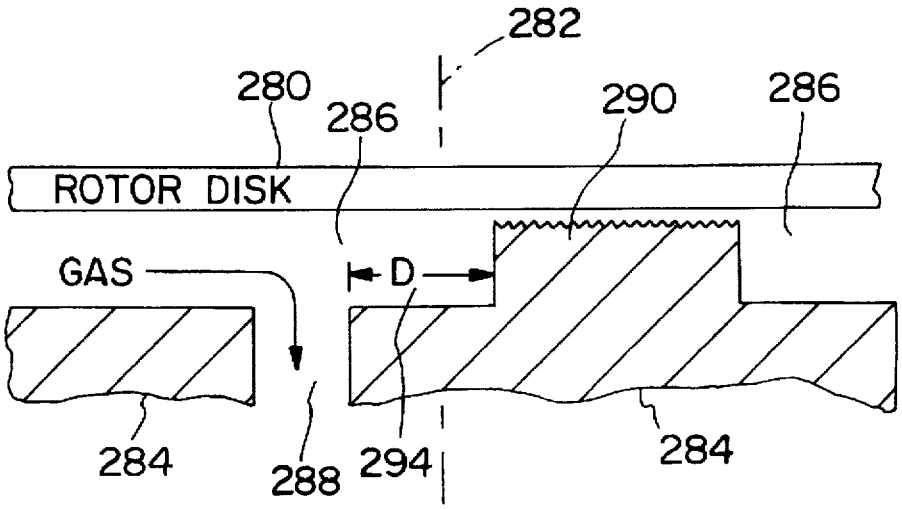
FIG. 10 is a partial schematic cross-sectional elevation view of a molecular drag stage, illustrating a further embodiment of the invention.

A further aspect of the invention is described with reference to FIG. 10. A partial schematic elevation view of a molecular drag stage is shown in FIG. 10. A rotor disk 280 rotates about an axis 282. A stator 284 positioned below disk 280 defines a tangential flow channel 286 and an outlet 288 from tangential flow channel 286. A stationary baffle 290 is positioned in tangential flow channel 286 at one circumferential location. In accordance with this aspect of the invention, outlet 288 is spaced from baffle 290 by a distance D, thereby defining a space 294 for accumulation of particles. In particular, particles entrained in the gasflow through tangential flow channel 286 have a tendency to move into space 294 and accumulate there, rather than passing through outlet 288. By accumulating particles before they reach the gap between baffle 290 and rotor disk 280, the risk of rotor disk sticking due to particulate accumulation in the gap is reduced. The spacing between outlet 288 and baffle 290 is selected to provide sufficient space for accumulation of particles, while minimizing the reduction in pumping length of the tangential flow channel 286.

Figure 11:
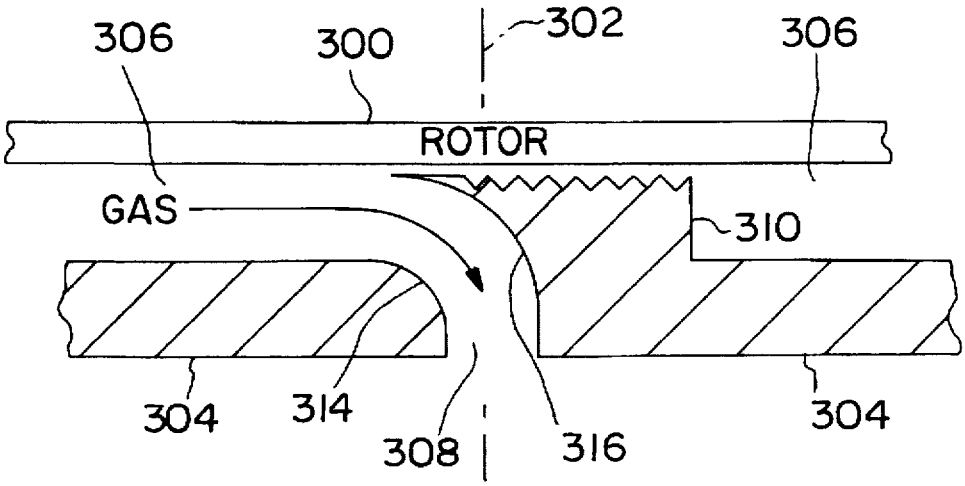
FIG. 11 is a partial schematic cross-sectional elevation view of a molecular drag stage, illustrating yet another embodiment of the invention.

A further aspect of the invention is described with reference to FIG. 11. A partial schematic elevation view of a molecular drag stage is shown in FIG. 11. A rotor 300 rotates about an axis 302. A stator 304 positioned below rotor 300 defines a tangential flow channel 306 and an outlet 308. A stationary baffle 310 is positioned in tangential flow channel 306 at one circumferential location. In accordance with this aspect of the invention, the stator 304 and the baffle 310 are shaped to provide a smoothly-curved transition between the tangential flow channel 306 and the outlet 308. This configuration produces a laminar flow without substantial turbulence. As a result, particles entrained in the gas flow tend to remain in the gas flow rather than accumulating in the gap between baffle 310 and rotor disk 300. As shown in FIG. 11, stator 304 is provided with a smoothly-curved surface 314, and baffle 310 is provided with a smoothly-curved surface 316, in the region of the transition between tangential flow channel 306 and outlet 308.

Figure 12:
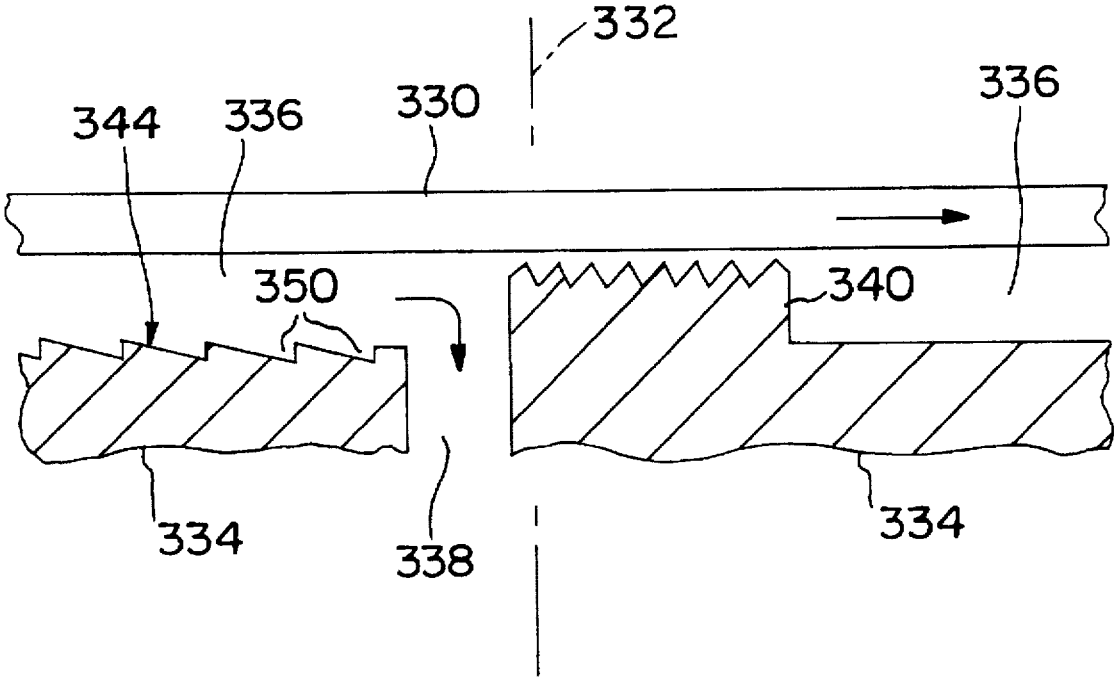
FIG. 12 is a partial schematic cross-sectional elevation view of a molecular drag stage, illustrating a further embodiment of the invention.

A further aspect of the invention is described with reference to FIG. 12. A partial schematic cross-sectional elevation view of a molecular drag stage is shown in FIG. 12. A rotor disk 330 rotates about an axis 332. A stator 334 positioned below rotor disk 330 defines a tangential flow channel 336 and an outlet 338. A stationary baffle 340 is positioned in the tangential flow channel at one circumferential location. In accordance with this aspect of the invention, a surface 344 of stator 334 which defines tangential flow channel 336 is provided with a pattern of grooves 350. However, other surface irregularities which promote accumulation of particles may be used. Particles entrained in the gas flow may accumulate in the grooves 350 before reaching the gap between baffle 340 and rotor disk 330, thereby reducing the risk of rotor sticking due to particulate accumulation. The grooves or other surface irregularities may be provided on the bottom surface of tangential flow channel 336 as shown in FIG. 12 or on the circumferential wall of the tangential flow channel, or both. In each case, the grooves or other surface irregularities are selected to promote particulate accumulation, while avoiding significant adverse effect on the pumping capability of the molecular drag stage.

Figure 13:
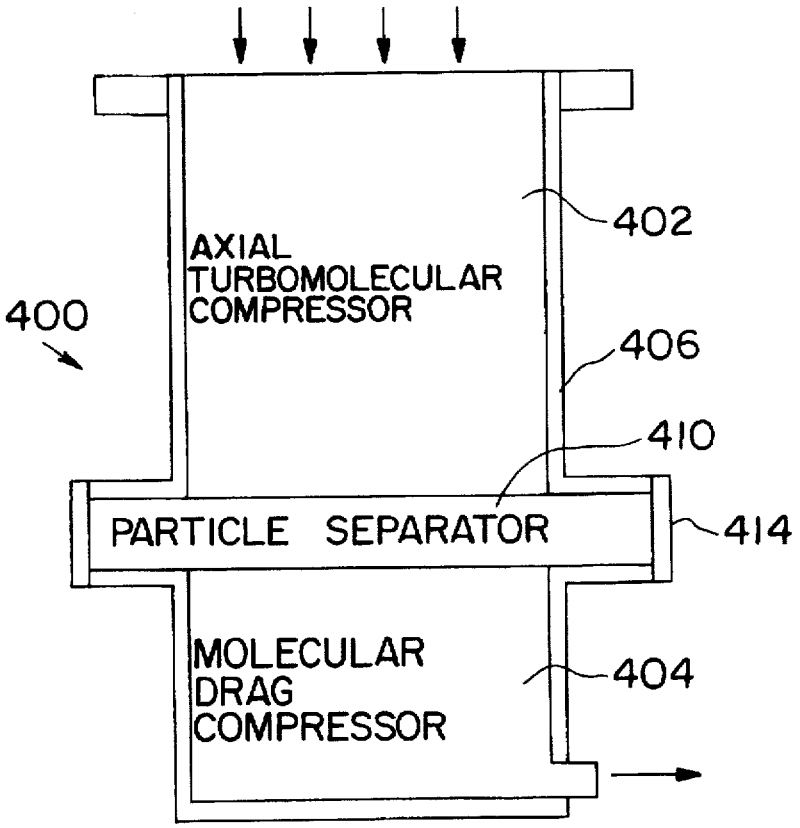
FIG. 13 is a schematic representation of a high vacuum pump, incorporating a further embodiment of the invention.

An additional aspect of the present invention is described with reference to FIGS. 13 and 14. A high vacuum pump 400 includes an axial turbomolecular compressor 402, including several axial turbomolecular stages, and a molecular drag compressor 404, including several molecular drag stages, all disposed within an outer housing 406. A particle separator 410 is mounted within the housing 406 between turbomolecular compressor 402 and molecular drag compressor 404. The particle separator 410 removes particles from the gas before the particles reach the molecular drag stages, thereby reducing particulate accumulation in the molecular drag stages. A variety of different particle separators are known to those skilled in the art. The housing 406 may be provided with a port 414 for cleaning of the particle separator 410, either by providing access to the particle separator for cleaning, or by permitting an element of the particle separator to be removed for cleaning.

Figure 14:
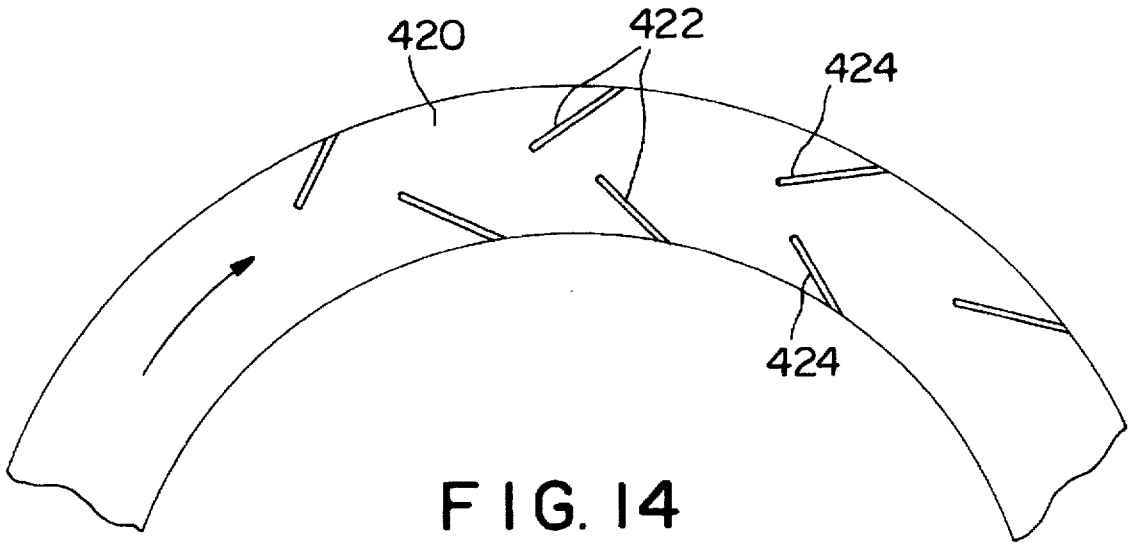
FIG. 14 is a partial plan view of one embodiment of the separator shown in FIG. 13.

An example of a suitable particle separator is shown in FIG. 14. A molecular drag stage is modified to function as a particle separator. In particular, a molecular drag stage includes a rotor disk and a stator which defines a tangential flow channel 420. Obstructions 422 positioned in tangential flow channel 420 cause turbulence in the gas flow and define recesses 424 for particle accumulation. As indicated above, different types of particle separators may be utilized within the scope of the present invention.

Figure 15:
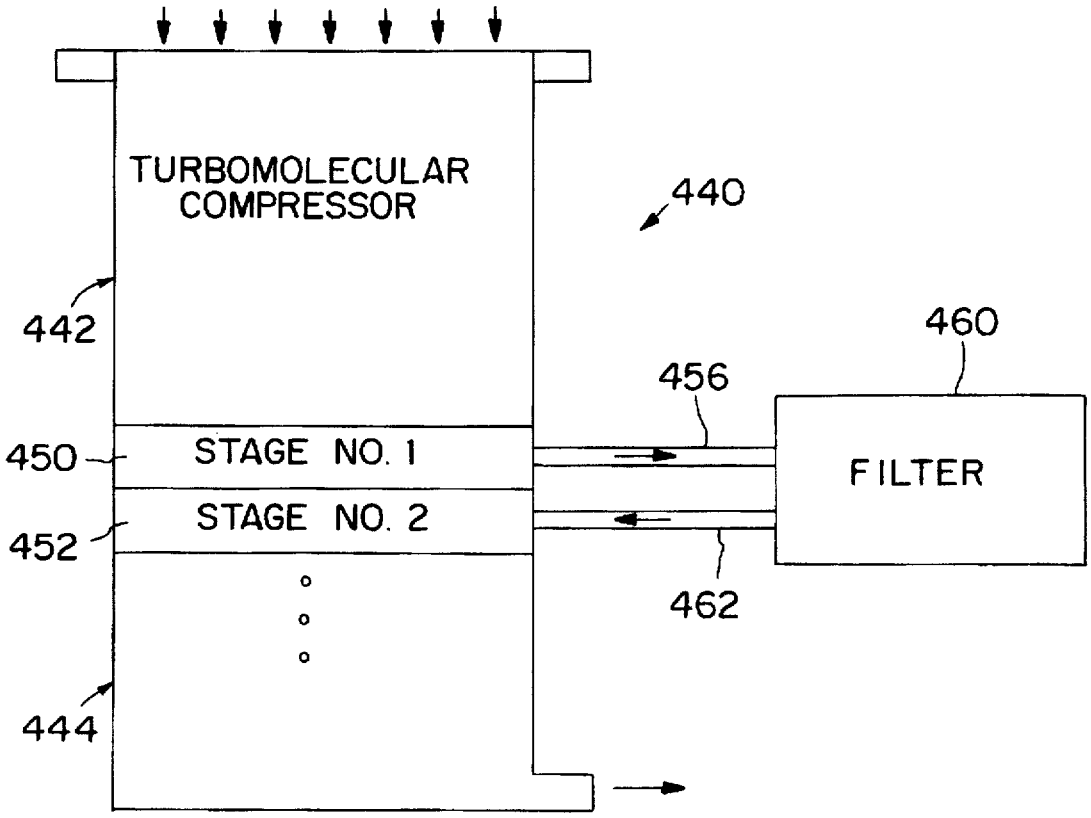
FIG. 15 is a block diagram of another embodiment of the invention.

A further aspect of the invention is described with reference to FIG. 15. A high vacuum pump 440 includes a turbomolecular compressor 442 and a molecular drag compressor 444. As noted above, the turbomolecular compressor 442 typically includes several axial turbomolecular stages, and the molecular drag compressor 444 typically includes several molecular drag stages. The molecular drag compressor 444 includes at least a first molecular drag stage 450 and a second molecular drag stage 452. A conduit 456 is connected between an outlet of first molecular drag stage 450 and an inlet of a particulate filter 460. A conduit 462 is connected between an outlet of particulate filter 460 and an inlet of second molecular drag stage 452. Thus, gas passing between the first and second molecular drag stages is filtered by particulate filter 460. By way of example, the conduit 120 shown in FIGS. 2–4 between tangential flow channels 110 and 112 may be eliminated and replaced by the connection through conduits 456 and 462 and particulate filter 460 as shown in FIG. 15. Alternatively, the particulate filter 460 may be connected before the first stage of the molecular drag compressor so as to remove particles before they reach the first molecular drag stage.

While there have been shown and described what are at present considered the preferred embodiments of the present invention, it will be obvious to those skilled in the art that various changes and modifications may be made therein without departing from the scope of the invention as defined by the appended claims.

What is claimed is:

1. A molecular drag compressor comprising:

a rotor disk coupled to a drive shaft for rotation about an axis;

a stator disposed around said rotor disk, said stator defining a tangential flow channel, an inlet to said tangential flow channel and an outlet from said tangential flow channel; and a stationary baffle disposed in said tangential flow channel adjacent to said outlet, said baffle and said rotor disk having a gap between them, a surface of said baffle facing said rotor disk having surface irregularities including peaks for defining said gap and valleys between said peaks for accumulation of particles.

2. The molecular drag compressor as defined in claim 1 wherein said peaks comprise spaced-apart ridges.

3. The molecular drag compressor as defined in claim 2 wherein said valleys between said ridges comprise triangular grooves.

4. The molecular drag compressor as defined in claim 2 wherein said ridges have sharp edges which are substantially uniformly spaced from said rotor disk.

5. The molecular drag compressor as defined in claim 2 wherein said spaced-apart ridges are disposed substantially perpendicular to a direction of rotation of said rotor disk.

6. The molecular drag compressor as defined in claim 2 wherein said ridges are spaced apart by distances in a range of about 5 to 25 times the dimension of said gap.

7. The molecular drag compressor as defined in claim 2 wherein said valleys have depths in a range of about 0.5 to 2 times the spacings between said ridges.

8. The molecular drag compressor as defined in claim 1 wherein said outlet is spaced upstream in a gas flow from said stationary baffle, thereby defining a space between said outlet and said baffle for particulate accumulation.

9. The molecular drag compressor as defined in claim 1 wherein said stator and said stationary baffle are shaped to provide a smoothly-curved transition between said tangential flow channel and said outlet, thereby producing laminar flow from said tangential flow channel to said outlet.

10. The molecular drag compressor as defined in claim 1 wherein said tangential flow channel includes at least one surface having surface irregularities which promote accumulation of particles.

11. An integral high vacuum pump comprising:

an outer pump housing having an axis;

an axial turbomolecular compressor disposed in said housing;

a molecular drag compressor disposed in said housing, said turbomolecular compressor and said molecular drag compressor each having a rotating portion coupled to a single motor drive shaft aligned along said axis; and a particle separator disposed in said housing between said turbomolecular compressor and said molecular drag compressor for removing particles from gas flowing from said turbomolecular compressor to molecular drag compressor.

12. An integral high vacuum pump comprising:

an outer pump housing having an axis;

an axial turbomolecular compressor disposed in said housing;

a molecular drag compressor disposed in said housing, said turbomolecular compressor and said molecular drag compressor each having a rotating portion coupled to a single motor drive shaft aligned along said axis, said molecular drag compressor having first and second stages, each having an inlet and an outlet; and a particulate filter coupled in a conduit between the outlet of said first stage and the inlet of said second stage.

13. The integral high vacuum pump as defined in claim 12 wherein said particulate filter is located externally of said pump housing.

14. An integral high vacuum pump comprising:

an outer pump housing having an axis;

an axial turbomolecular compressor disposed in said housing;

a molecular drag compressor disposed in said housing, said turbomolecular compressor and said molecular drag compressor comprising vacuum pumping stages, each said vacuum pumping stage having a rotating portion coupled to a single motor drive shaft aligned along said axis, said molecular drag compressor including at least one molecular drag stage comprising:

a stator disposed around said rotating portion, said rotating portion being a rotor disk, said stator defining a tangential flow channel, an inlet to said tangential flow channel and an outlet from said tangential flow channel; and a stationary baffle disposed in said tangential flow channel adjacent to said outlet, said baffle and said rotor disk having a gap between them, a surface of said baffle facing said rotor disk having surface irregularities including peaks for defining said gap and valleys between said peaks for accumulation of particles.

15. The integral high vacuum pump as defined in claim 14 wherein said peaks comprise spaced-apart ridges.

16. The integral high vacuum pump as defined in claim 15 wherein said valleys between said ridges comprise triangular grooves.

17. The integral high vacuum pump as defined in claim 15 wherein said ridges have sharp edges which are substantially uniformly spaced from said rotor disk.

18. The integral high vacuum pump as defined in claim 15 wherein said spaced-apart ridges are disposed substantially perpendicular to a direction of rotation of said rotor disk.

19. The integral high vacuum pump as defined in claim 15 wherein said ridges are spaced apart by distances in a range of about 5 to 25 times the dimension of said gap.

20. The integral high vacuum pump as defined in claim 15 wherein said valleys have depths in a range of about 0.5 to 2 times the spacings between said ridges.

21. The integral high vacuum pump as defined in claim 14 wherein said outlet is spaced upstream in a gas flow from said stationary baffle, thereby defining a space between said outlet and said baffle for particulate accumulation.

22. The integral high vacuum pump as defined in claim 14 wherein said stator and said stationary baffle are shaped to provide a smoothly-curved transition between said tangential flow channel and said outlet, thereby producing laminar flow from said tangential flow channel to said outlet.

23. The integral high vacuum pump as defined in claim 14 wherein said tangential flow channel includes at least one surface having surface irregularities which promote accumulation of particles.

24. A molecular drag compressor comprising:

a rotor disk coupled to a drive shaft for rotation about an axis;

a stator disposed around said rotor disk, said stator defining a tangential flow channel, an inlet to said tangential flow channel and an outlet from said tangential flow channel; and a stationary baffle disposed in said tangential flow channel adjacent to said outlet, wherein said stator and said stationary baffle are shaped to provide a smoothly-curved transition between said tangential flow and said outlet, thereby producing laminar flow from said tangential flow channel to said outlet.

25. A molecular drag compressor comprising:

a rotor disk coupled to a drive shaft for rotation about an axis;

a stator structure disposed around said rotor disk, said stator defining a tangential flow channel, an inlet to said tangential flow channel and an outlet from said tangential flow channel; and a stationary baffle disposed in said tangential flow channel adjacent to said outlet, wherein said tangential flow channel includes at least one surface having surface irregularities which promote accumulation of particles.

* * * * *